United States Patent [19]

Wood

[11] Patent Number: 4,815,688

[45] Date of Patent: Mar. 28, 1989

[54] MOUNTING FOR ATTACHMENTS TO A WHEELCHAIR, A GERIATRIC CHAIR AND THE LIKE

[76] Inventor: Charles F. Wood, 8341 W. Foothill Dr., Peoria, Ariz. 85345

[21] Appl. No.: 23,448

[22] Filed: Mar. 9, 1987

[51] Int. Cl.[4] ..... A47G 29/00

[52] U.S. Cl. ..... 248/283; 248/118; 248/230; 297/194; 297/412

[58] Field of Search ..... 248/283, 282, 285, 1 C, 248/219.4, 218.4, 118, 118.1, 230, 207, 214; 211/98; 297/DIG. 4, 194, 161, 412, 415, 422, 171, 162, 188, 417, 488; 108/152, 141

[56] References Cited

U.S. PATENT DOCUMENTS

| | | | |
|---|---|---|---|
| 1,283,869 | 11/1918 | Nelson et al. | 108/141 |
| 1,312,274 | 8/1919 | Sculthorp | 108/141 |
| 1,337,867 | 4/1920 | Whitaker | 248/214 |
| 1,516,795 | 11/1924 | Schwarting | 248/118 X |
| 2,533,893 | 12/1950 | Nussbaum | 108/152 X |
| 2,642,250 | 6/1953 | Kasnowich | 248/214 X |
| 2,766,463 | 10/1956 | Bendersky | 248/118 |
| 3,522,887 | 8/1970 | Petersen | 248/207 X |
| 4,174,866 | 11/1979 | Rhyan | 297/194 |
| 4,339,061 | 7/1982 | Dunn | 297/194 X |
| 4,679,756 | 7/1987 | Wood | 248/285 |

*Primary Examiner*—Ramon S. Britts
*Assistant Examiner*—Karen J. Chotkowski
*Attorney, Agent, or Firm*—Cahill, Sutton & Thomas

[57] ABSTRACT

A mounting, detachably attachable to the frame of a wheelchair, geriatric chair or other tubular member, interchangeably supports arm rests, baskets and the like, through a stanchion extending therefrom.

5 Claims, 3 Drawing Sheets

MOUNTING FOR ATTACHMENTS TO A WHEELCHAIR, A GERIATRIC CHAIR AND THE LIKE

CROSS REFERENCE TO RELATED APPLICATIONS

The subject matter of the present application is related to the subject matter contained in copending United States patent application entitled "MOUNTING FOR A WHEELCHAIR SERVICE TRAY", filed on May 14, 1986, assigned Ser. No. 863,048 now U.S. Pat. No. 4,679,756 and describing an invention made by the present inventor.

BACKGROUND OF THE INVENTION

1. Field of the Invention

The present invention relates to mountings and, more particularly, to mountings for vertically and pivotally locating devices of assistance to handicapped persons.

2. Description of Related Art

Those persons who, due to illness of physical infirmities, are confined to a bed, wheelchair, geriatric chair or the like, must generally resort to a makeshift device to assist them in handling everday needs. For persons who have lost some or all ability to move an arm in an effective manner, some type of support is necessary. When these persons use a wheelchair for ambulation, a particular problem arises as slings or more rigid supports suspended from or attached to the person's body may be difficult or cumbersome to use. To simply let the arm dangle or rest upon the user's lap are not always acceptable alternatives.

A person confined to a wheelchair must, from time to time, convey various articles. A compartment for such articles may be in the manner of a pouch suspended from the rear of the wheelchair. Such a pouch may be impossible to access. Alternatively, a similar pouch may be suspended from the sides of the wheelchair; such a pouch may be of limited size or configuration due to potential interference with the wheels and manual rotation thereof. Some type of enclosure may be secured to the foot support mechanism but such enclosure must be relatively small sized to preclude interference with the user's legs and feet. Access to any side mounted or front mounted pouch may still be a problem for certain users.

A table top like surface is of great benefit to a wheelchair or geriatric chair user to assist and to render more easy daily functions of reading, writing and eating. The prior art devices for such purposes are awkward, cumbersome, difficult to manipulate and to store. Furthermore, certain wheelchair or geriatric chair users need assistance in communicating and readily available pictographs or the like to which the user can point would be of great benefit.

SUMMARY OF THE INVENTION

The present invention is directed to a mounting detachably attachable to the tubular components of a wheelchair arm rest or the like, which mounting receivingly retains a stanchion. The stanchion supports any of several devices such as an arm rest, collapsible basket or table surface. Each of these devices, through pivotable movement of the stanchion with respect to the mounting, may be swung into and out of a position of use. Moreover, each of the devices is height adjustable to optimize utility and convenience through interaction between the mounting and the stanchion.

It is therefore a primary object of the present invention to provide a mounting detachably attachable to the arm rest of any conventional wheelchair or geriatric chair for pivotally, vertically and adjustably supporting any of a selection of devices of assistance to wheelchair or geriatric chair occupant.

Another object of the present invention is to provide a mounting for supporting a pivotable and vertically adjustable arm rest upon a wheelchair or geriatric chair or the like.

Yet another object of the present invention is to provide a mounting for supporting a basket from a wheelchair or a geriatric chair at a location accessible to a user and repositionable by the user out of the way for egress and ingress without detachment of the basket.

Still another object of the present invention is to provide a mounting secured to a wheelchair or geriatric chair for pivotally supporting a table surface.

A further object of the present invention is to provide a mounting detachably attachable to the tubular framework of a wheelchair or the like for pivotally, vertically and adjustably supporting any of a plurality of devices.

A yet further object of the present invention is to provide a mounting usable with a wheelchair or a geriatric chair for supporting, in the alternative, an arm rest, a basket or a table surface.

A still further object of the present invention is to provide a mounting attachable to a tubular member for slidably receiving and vertically retaining a stanchion extending from a device to be supported.

A still further object of the present invention is to provide apparatus for use with a wheelchair or a geriatric chair to permit an occupant to be more independent and less dependent upon others for anticipated daily needs.

These and other objects of the present invention will become apparent to those skilled in the art as the description thereof proceeds.

BRIEF DESCRIPTION OF THE DRAWINGS

The present invention may be described with greater specificity and clarity with reference to the following drawings, in which.

DESCRIPTION OF THE PREFERRED EMBODIMENT

Figure 1:
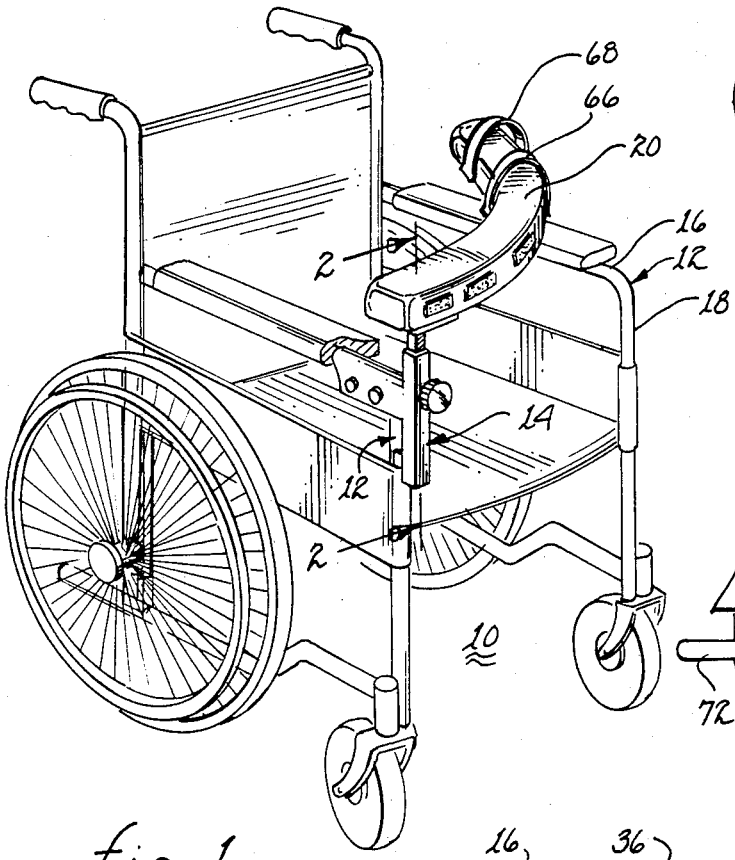
FIG. 1 is a perspective view of a conventional wheelchair having a mounting attached thereto for supporting an arm rest.
Figure 4:
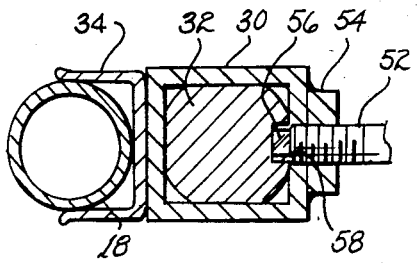
FIG. 4 is a cross-sectional view taken along lines 4—4, as shown in FIG. 2.
Figure 2:
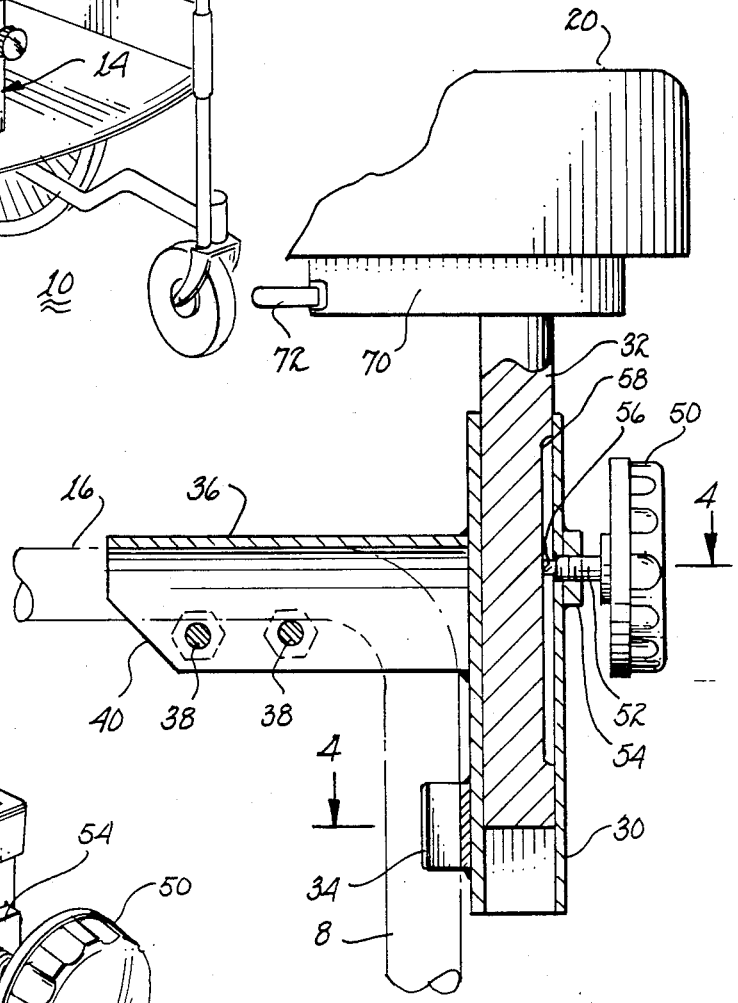
FIG. 2 is a partial cross-sectional view taken along lines 2—2, as shown in FIG. 1.
Figure 3:
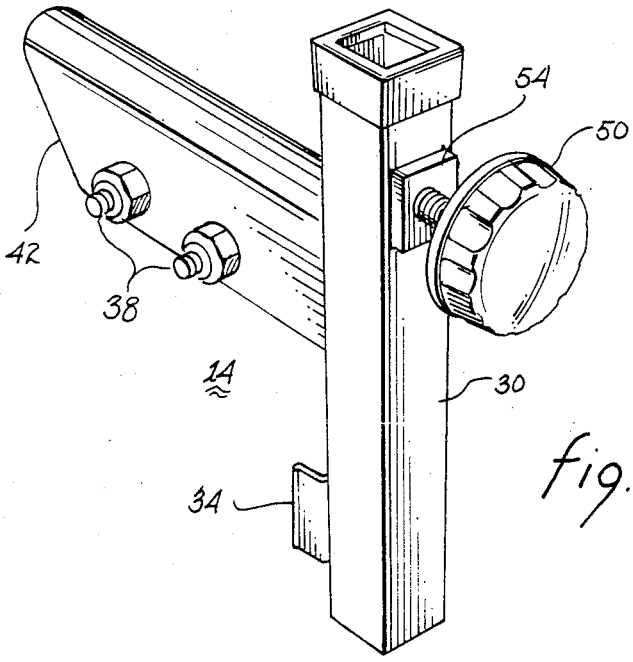
FIG. 3 is a perspective view of the mounting shown in FIG. 2.

Hospital beds, wheelchairs, geriatric chairs and other institutional furniture for supporting a person lodged therein generally include vertical tubular members as part of the frame. Such a member, formed as part of an arm rest of a wheelchair 10, is depicted in FIG. 1 and identified by numeral 12. A mounting 14 is detachably attached to the horizontal and vertical parts, 16, 18 of member 12. The mounting may be employed to support an arm rest 20, as depicted in FIG. 1. Referring specifically to FIGS. 2, 3 and 4, details of mounting 14 will be described in greater detail. The mounting includes a vertical tube means 30 for receiving a stanchion 32, or the like, which stanchion is associated with the device to be supported by mounting 14. A guide 34 extends from member 30 for receiving therein in a snug manner vertical part 18 of tubular member 12. The guide may be configured as a clip to grippingly engage the vertical part. An inverted U-shaped channel member 36 extends from tube means 30 for receiving an resting upon horizontal part 16 to secure mounting 14 in place. Nut and bolt means 38 penetrably engage depending shrouds 40, 42 of channel member 36 at a location beneath horizontal member 16. Upon tightening of nut and bolt means 38, shrouds 40, 42 will grippingly engage horizontal member 16 to inhibit movement of channel member 36 with respect to the horizontal part. It may be appreciated that guide 34, disposed laterally offset from the longitudinal axis of channel member 36, will resist rotation of mounting 14 about the longitudinal axis of the channel member. By inspection it will also become evident that mounting 14 is readily detachable from wheelchair 10 by loosening nut and bolt means 38 to permit the mounting to be used upon another wheelchair or upon other items, such as a portion of the tubular frame of a hospital bed, etc.

A hand wheel 50 includes a threaded shank 52 in threaded engagement with a plate or nut 54 fixedly attached to tube means 30. The threaded shank may include a protrusion 56 disposed at the terminal end thereof. Upon rotation of hand wheel 50, protrusion 56 will become translated rectilinearly into and out of tube means 30. Stanchion 32 is slidably locatable within tube means 30. Preferably, both the tube means and the stanchion are four sides to preclude rotation of the stanchion about its longitudinal axis independent of the tube means. The vertical position of the stanchion relative to the tube means is adjustably locatable by frictional engagement between protrusion 56 and slot 58 extending longitudinally along the stanchion. Upon turning of hand wheel 50, usually in the clockwise direction, protrusion 56 will be translated into slot 58 until it bears against the bottom surface of the slot. The resulting frictional interaction between the protrusion and the bottom surface will tend to lock the stanchion with respect to tube means 30 to prevent translation of the stanchion relative to the tube means. Vertical repositioning of the stanchion is readily effected by turning hand wheel 50 counterclockwise to reduce the friction between protrusion 56 and slot 58 and thereafter vertically reposition the stanchion.

As illustrated in FIGS. 1 and 2, stanchion 32 may be used to support an arm rest 20. The arm rest may be curved, as illustrated, to best accommodate positioning of a user's arm. Straps 66, 68 may be incorporated to retain the user's arm upon the arm rest. A ratchet mechanism 70 may be secured to the bottom of arm rest 20 for attaching the arm rest to stanchion 32. The ratchet mechanism, which may be of the type illustrated and described in U.S. patent application entitled "MOUNTING FOR A WHEELCHAIR SERVICE TRAY", Ser. No. 863,048, filed May 14, 1986. That is, the ratchet mechanism may permit pivotal movement of the arm rest toward the user to a degree desired and prevent unwanted outward pivotal movement except upon release by manipulation of lever 72. It will be appreciated that the arm rest can be swung off to the side of wheelchair 10 to permit ingress and egress. Vertical reposition of the arm rest can be effected by manipulation of hand wheel 50 to raise or lower stanchion 32, as described above.

Figure 5:
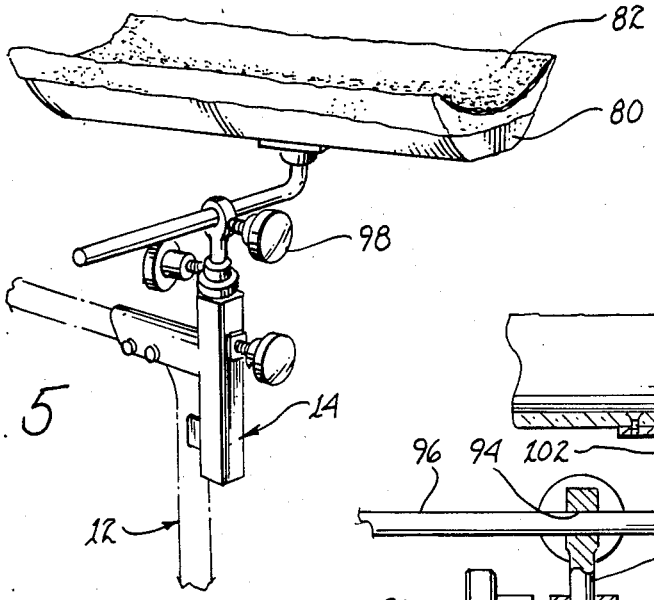
FIG. 5 illustrates a swiveling and rotatable arm rest detachably supported by a wheelchair or geriatric chair attached mounting.
Figure 6:
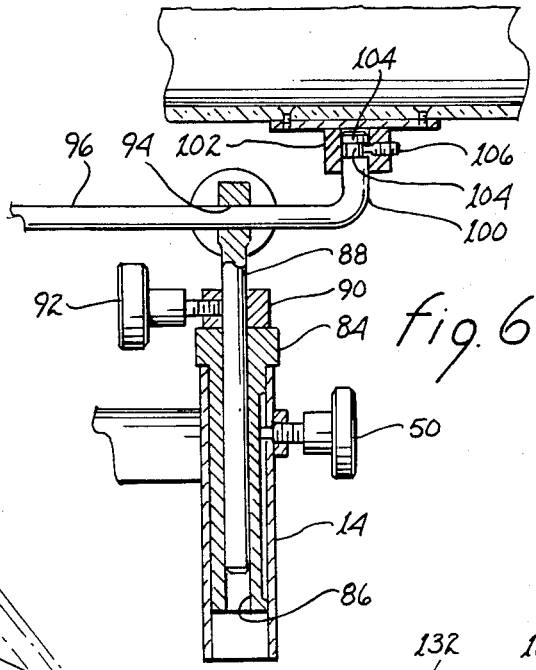
FIG. 6 is a partial cross-sectional view of the apparatus shown in FIG. 5.

Referring jointly to FIGS. 5 and 6, there is illustrated an arm rest 80 having a generally U-shaped trough 82 for receiving a user's arm. The arm rest is secured to tube means 12 of wheelchair 10 via mounting 14. For special medical and/or comfort reasons, arm rest 80 is positionable with respect to mounting 14 at any of a multitude of adjustable positions. Stanchion 84, which is like stanchion 32, is vertically positionally adjustable by operation of hand wheel 50, as described above. The stanchion includes a central passageway 86 for receiving a rod 88. A collar 90 penetrably receives rod 88 and includes a thumb wheel 92 threadedly engaging the collar to lock the collar along a selected location of the rod. The collar, bearing against the upper end of stanchion 84, limits the downward position of the rod with respect to the stanchion. The upper end of rod 88 includes an eyelet 94 for slidably receiving a bar 96. A thumb wheel 98 cooperates with the eyelet to secure bar 96 within the eyelet and permit, on a selective basis, translation of the bar through the eyelet. Bar 96 includes a foot 100 extending vertically upwardly to engage a collar 102 depending from the undersurface of arm rest 80. An annular groove 104 is located within collar 102. A set screw 106 extending from collar 102 may be employed to engage annular groove 104 and lock the arm rest to foot 100. The set screw may also be used to lock the arm rest against pivotal movement about foot 100.

Through the above-described support mechanisms associated with arm rest 80, it will become evident that the arm rest is vertically adjustable through two discrete ranges, the extension of stanchion 84 with respect to mounting 14 and the extension of rod 88 with respect to stanchion 84. The arm rest is also pivotable about the vertical axis of rod 88. Arm rest 80 may be offset laterally from the vertical axis of rod 88 through sliding movement of bar 96 with respect to eyelet 94. Rotation of arm rest 80 about the vertical axis represented by foot 100 is available through release of locking engagement between annular groove 104 by set screw 106. With such plurality of adjustments, the arm rest may be used for therapeutic purposes, as may be necessary. Alternatively, the arm rest can be positioned to support the user's arm at a location and orientation most comfortable to the user.

Figure 7:
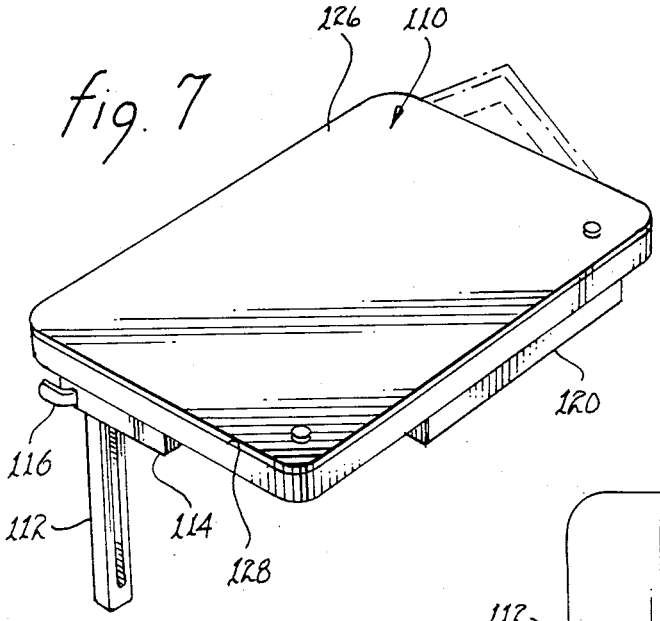
FIG. 7 illustrates a pivotable table surface securable to the mounting attached to a wheelchair, as shown in FIG. 1.
Figure 9:
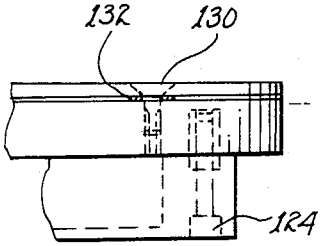
FIG. 9 is a partial end view taken along lines 9—9, as shown in FIG. 8.
Figure 8:
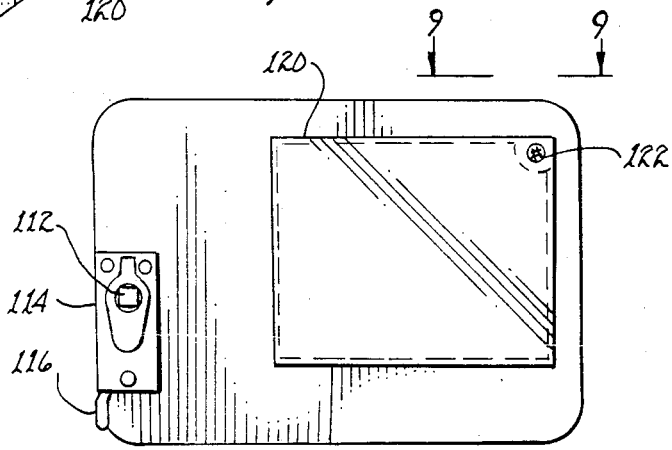
FIG. 8 is a bottom view of the table surface shown in FIG. 7.

FIGS. 7, 8 and 9 illustrate the use of a table surface 110 in conjunction with mounting 14. The table includes a stanchion 112 for engagement with tube means 30 of mounting 14 in the manner described above. The stanchion may be secured to table surface 110 through a ratchet mechanism 114 which permits pivotal movement of the table toward a user but precludes pivotal movement in the opposite direction, except upon release through manipulation of lever 116. A ratchet mechanism of this type is illustrated in U.S. patent application entitled "MOUNTING FOR A WHEELCHAIR SERVICE TRAY", Ser. No. 863,048, filed May 14, 1986. Table surface 110 may include a drawer 120 pivotally secured to the underside by means of pivot mechanism 122. The drawer may be essentially a box for retaining various items and of a size and depth commensurate with the items to be retained. The pivot mechanism may comprise a simple bolt 124 in threaded engagement with the underside of table surface 110.

Table surface 110 may include a transparent plate 126 slightly displaced above surface 128 of the table surface. This displacement may be maintained by screws or bolts 130 securing plate 126 to the table surface 110 but displaced therefrom by spacers 132. With such arrangement, a plurality of pictographs or the like may be placed beneath plate 126 to permit a user to communicate his/her desires by pointing to one or another of the depicted symbols. Obviously, the pictographs can be interchanged beneath plate 126 as necessary. By using a transparent plate over the pictographs, the surface of the plate can be used as a work surface with or without reference to the symbols depicted.

Figure 10:
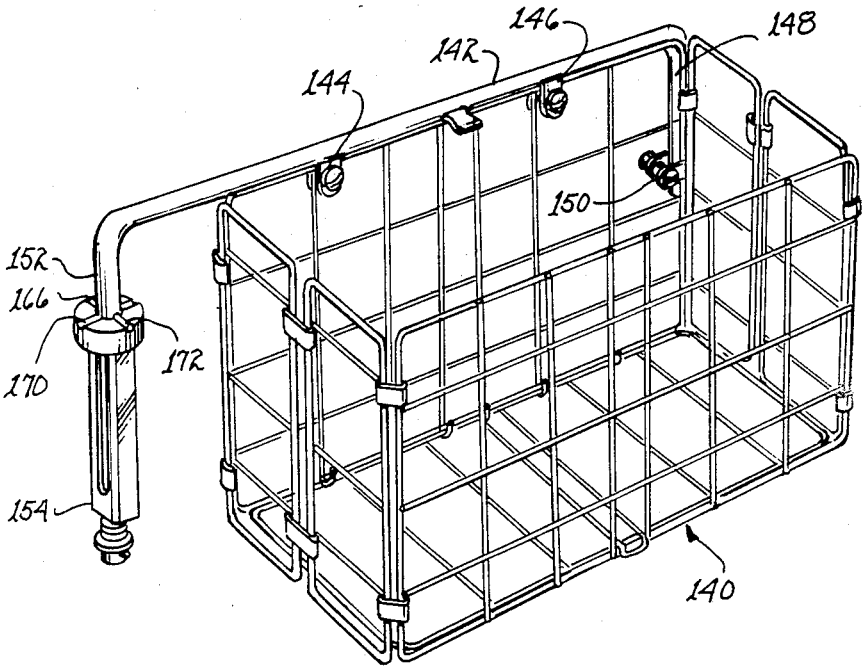
FIG. 10 illustrates a collapsible basket detachably supportable upon a wheelchair attached mounting of the type shown in FIG. 1.
Figure 11:
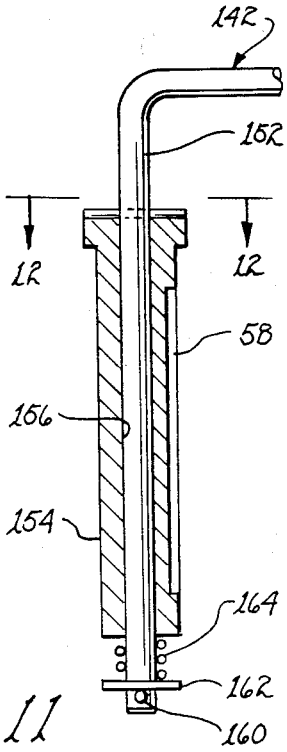
FIG. 11 illustrates a detail of the basket support apparatus.
Figure 12:
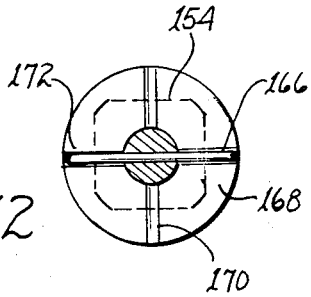
FIG. 12 is an end view taken along lines 12—12, as shown in FIG. 11.

FIGS. 10, 11 and 12 illustrate a collapsible basket which may be detachably attached to mounting 14 on wheelchair 10. Basket 140, which may be of a commercially available type that is collapsible by raising the bottom and folding the sides inwardly may be used. An arm 142 is secured to the upper rear edge of the basket by clips 144, 146. A downwardly extending segment 148 of the arm is secured to the rear side of the basket by a further clip 150. In this manner, basket 140 is rigidly secured to arm 142. The other end of the arm includes a downwardly depending segment 152 for penetrable engagement with a stanchion 154. The stanchion includes a passageway 156 extending therethrough for receiving segment 152. The lower end of the segment includes a threaded portion 158 for threadedly receiving a nut 160 supporting a washer 162. Intermediate the washer and the lower end of stanchion 154 is disposed a compressible coil spring 164 to bias segment 152 downwardly into stanchion 154. The downward movement of arm 42 is precluded by bar 166 extending from segment 152. A pair of orthogonally oriented slots 170, 172 are disposed in surface 168. Thses slots, in combination with the downward force upon segment 152 urged by coil spring 164, serves in the manner of a detent to locate basket 140 across the front of the wheelchair or extended forwardly from the wheelchair. Moreover, the basket can be located in a detented position at the complementary locations. Stanchion 154 may include a slot 58 for cooperative engagement with hand wheel 50 (see FIG. 2) to permit vertical positioning of basket 140.

Figure 13:
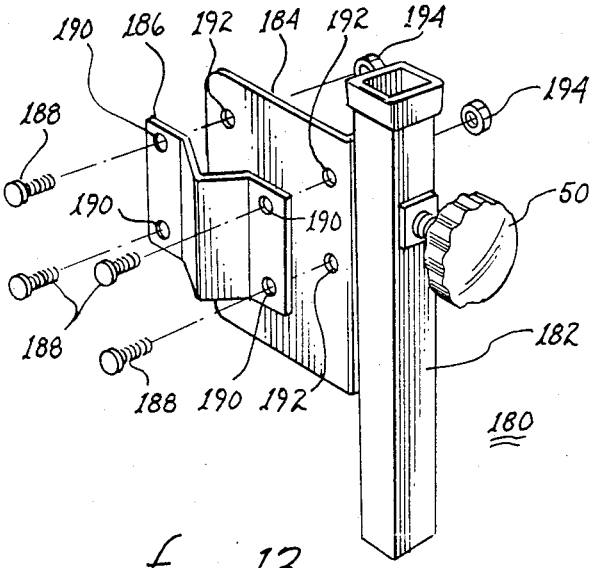
FIG. 13 illustrates a variant of the mounting shown in FIG. 1.
Figure 14:
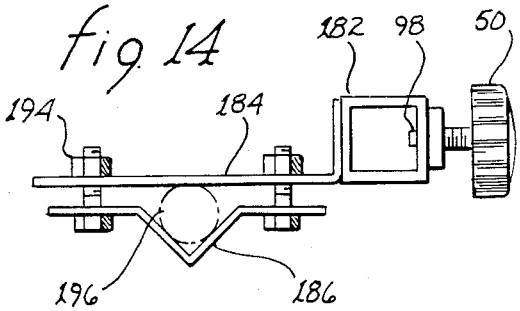
FIG. 14 is a top view of the variant shown in FIG. 13.

Referring jointly to FIGS. 13 and 14, a variant 180 of mounting 14 will be described. A tube means 182 is usable to support a stanchion of the type discussed above. A plate 184 extends from the tube means 182 to serve as a primary support plate for the tube means. A bracket 186 is attachable to support plate 184 by a plurality of bolts 188 penetrating apertures 190 in the bracket and apertures 192 in the support plate for threaded engagement with nuts 194. In one embodiment, nuts 194 may be permanently secured to plate 184. As particularly illustrated in FIG. 14, bracket 186, in combination with support plate 184, is configured to receive and grippingly engage a vertical support 196, which may be vertical part 18 illustrated in FIGS. 1 and 2. In this manner, variant 180 is attachable to any vertical member to provide a mounting for any one of the stanchions discussed above which support the respective items of utility. In the manner depicted in FIG. 2, hand wheel 50 cooperates with tube means 182 to vertically locate and maintain a stanchion disposed therein through translatory movement of protrusion 198.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A mounting for supporting through a stanchion extending downwardly from each of any of a plurality of selectable devices, the selectable device upon a frame which frame has a generally horizontal component and a generally vertical component, said mounting comprising in combination:

(a) means for engaging the frame, said means for engaging including means for inhibiting rotation of said mounting about each of a horizontal axis and a vertical axis of said mounting, said means for inhibiting including first means for capturing at least a part of the horizontal component of the frame to inhibit rotation of said mounting about the vertical axis of said mounting, said first means for capturing having a longitudinal axis intersecting the vertical axis of said mounting and second means for capturing at least a part of the vertical component of the frame to inhibit rotation of said mounting about the horizontal axis of said mounting, said second means for capturing having a longitudinal axis parallel with the vertical axis of said mounting, each of said first and second means comprising one of a clip for restraining rotation of said mounting about one of the horizontal and vertical axes and a channel member for restricting rotation of said mounting about the other of said horizontal and vertical axes;

(b) vertically oriented tube means for supporting said engaging means and for receiving the stanchion;

(c) means for securing the stanchion vertically relative to said tube means upon insertion of the stanchion within said tube means and for selectively retaining the stanchion at such location; and (d) means for restricting rotation of the stanchion about its longitudinal axis relative to said tube means; whereby, said mounting supports a selected device at a locatable vertical position relative to the frame.

2. The mounting s set forth in claim 1 wherein said channel member includes a pair of opposed shrouds extending along opposed sides of the engaged frame part and means associated with said pair of shrouds for securing said mounting to the frame.

3. The mounting set forth in claim 1 wherein the frame includes horizontal and vertical members of an arm rest and wherein said channel member includes a pair of opposed shrouds for engaging opposed sides of the horizontal member of the arm rest and wherein said clip engages the vertical member of the arm rest.

4. A mounting for supporting, through a stanchion extending downwardly from each of any of a plurality of selectable devices, the selected device upon a tubular frame which frame has a generally horizontal component and a generally vertical component, said mounting comprising in combination:

(a) means for engaging the tubular frame, said means for engaging including means for inhibiting rotation of said mounting about each of a horizontal axis and a vertical axis of said mounting, said means for inhibiting includes first means for capturing at least a part of the horizontal component of the frame to inhibit rotation of said mounting about the vertical axis of said mounting, said first means for capturing having a longitudinal axis intersecting the vertical axis of said mounting and second means for capturing at least a part of the vertical component of the frame to inhibit rotation of said mounting about the horizontal axis, of said mounting said second means for capturing having a longitudinal axis parallel with the vertical axis of said mounting;

(b) vertically oriented tube means for supporting said engaging means and for receiving the stanchion;

(c) a stanchion disposed in said tube means and comprising a means for vertically locating the stanchion relative to said tube means and for selectively retaining the stanchion at such location; and (d) means for restricting rotation of the stanchion about its longitudinal axis relative to said tube means, whereby said mounting supports a selected device at a locatable vertical position relative to the tubular frame.

5. A mounting for supporting, through a stanchion extending downwardly from each of any of a plurality of selectable devices, the selected device upon a tubular frame which frame has a generally horizontal component and a generally vertical component, said mounting comprising in combination:

(a) means for engaging the tubular frame, said means for engaging including means for inhibiting rotation of said mounting about each of a horizontal axis and a vertical axis of said mounting, said means for inhibiting includes first means for capturing at least a part of the horizontal component of the frame to inhibit rotation of said mounting about the vertical axis of said mounting, said first means for capturing having a longitudinal axis intersecting the vertical axis of said mounting and second means for capturing at least a part of the vertical component of the frame to inhibit rotation of said mounting about the horizontal axis, of said mounting said second means for capturing having a longitudinal axis parallel with the vertical axis of said mounting;

(b) vertically oriented tube means for supporting said engaging means and for receiving the stanchion; and (c) a stanchion disposed in said tube means and comprising a means for vertically locating the stanchion relative to said tube means and for selectively retaining the stanchion at such location;

whereby said mounting supports a selected device at a locatable vertical position relative to the tubular frame.

* * * * *